US009077083B1

(12) United States Patent
Freeman et al.

(10) Patent No.: US 9,077,083 B1
(45) Date of Patent: Jul. 7, 2015

(54) DUAL-POLARIZED ARRAY ANTENNA

(75) Inventors: Paul J. Freeman, Broomfield, CO (US); Vlad Munteanu, Boulder, CO (US); Scott P. Bates, Boulder, CO (US); Thomas Caly, Louisville, CO (US); Travis Horne, Broomfield, CO (US)

(73) Assignee: BALL AEROSPACE & TECHNOLOGIES CORP., Boulder, CO (US)

( * ) Notice: Subject to any disclaimer, the term of this patent is extended or adjusted under 35 U.S.C. 154(b) by 400 days.

(21) Appl. No.: 13/564,501

(22) Filed: Aug. 1, 2012

(51) Int. Cl.
*H01Q 21/00* (2006.01)
*H01Q 13/10* (2006.01)
*H01Q 21/24* (2006.01)

(52) U.S. Cl.
CPC ..... *H01Q 21/24* (2013.01)

(58) Field of Classification Search
CPC .... H01Q 21/064; H01Q 13/085; H01Q 21/24
USPC ..... 343/893
See application file for complete search history.

(56) References Cited

U.S. PATENT DOCUMENTS

| | | | | |
|---|---|---|---|---|
| 4,763,131 | A * | 8/1988 | Rosser et al. | 343/792.5 |
| 5,086,304 | A * | 2/1992 | Collins | 343/778 |
| 5,309,165 | A * | 5/1994 | Segal et al. | 343/770 |
| 5,488,380 | A | 1/1996 | Harvey et al. | |
| 5,519,408 | A | 5/1996 | Schnetzer | |
| 5,949,382 | A | 9/1999 | Quan | |
| 6,075,493 | A | 6/2000 | Sugawara et al. | |
| 6,111,544 | A | 8/2000 | Dakeya et al. | |
| 6,252,556 | B1 | 6/2001 | Ito et al. | |
| 6,351,239 | B1 | 2/2002 | Mizuno et al. | |
| 6,480,167 | B2 | 11/2002 | Matthews | |
| 6,552,691 | B2 * | 4/2003 | Mohuchy et al. | 343/770 |
| 6,556,169 | B1 | 4/2003 | Fukuura et al. | |
| 6,791,497 | B2 | 9/2004 | Winebrand et al. | |
| 6,900,770 | B2 | 5/2005 | Apostolos | |
| 7,057,570 | B2 | 6/2006 | Irion, II et al. | |
| 7,405,698 | B2 | 7/2008 | de Rochemont | |
| 7,817,097 | B2 | 10/2010 | Margomenos | |
| 2003/0214450 | A1 * | 11/2003 | Lynch et al. | 343/772 |
| 2011/0057852 | A1 | 3/2011 | Holland et al. | |

FOREIGN PATENT DOCUMENTS

| | | |
|---|---|---|
| WO | WO 00/64008 | 10/2000 |

OTHER PUBLICATIONS

U.S. Appl. No. 13/401,600, filed Feb. 21, 2012, Lambert et al.
Hojjat et al., "Design and Analysis of New Fermi-like Tapered Slot Antennas," IEEE Antennas and Propagation Society International Symposium, 2000, vol. 3, pp. 1616-1619.

(Continued)

*Primary Examiner* — Dameon E Levi
*Assistant Examiner* — Ricardo Magallanes
(74) *Attorney, Agent, or Firm* — Sheridan Ross P.C.

(57) ABSTRACT

A dual polarized array antenna is disclosed. The array antenna includes a plurality of electrically conductive elements or posts, arranged in rows and columns. Multiple parallel slots are formed that intersect different rows and columns of electrically conductive elements. The slots receive feed elements that include a linear array of feed points. The feed points within each linear array alternate between a feed point associated with a first polarization and a feed point associated with a second polarization.

20 Claims, 6 Drawing Sheets

(56) References Cited

OTHER PUBLICATIONS

Holter, "Element for wideband and very wide-angle phased arrays," IEEE Antennas and Propagation Society International Symposium, 2001, vol. 2, pp. 440-443.
International Search Report and Written Opinion for International (PCT) Patent Application No. PCT/US2013/026770 mailed May 3, 2013, 12 pages.
Official Action for U.S. Appl. No. 13/401,600 mailed Oct. 1 , 2013, 6 pages.
Fisher "Design and Performance Analysis of A 1—40GHZ Ultra-Wideband Antipodal Vivaldi Antenna," German Radar Symposium GRS, 2000, 5 pages. (available at mw.roke.co.uk/resources/papers/analysis-of-a-Ultra-wideband-Antipodal-Vivaldi-Antenna.pdf).
Stasiowski "Broadband Array Antenna," Cobham, available at www.cobham.com/media/83841/Broadband%20Array%20Antenna.pdf, Feb. 20, 2012, 18 pages.
Wang et al. "Design of a Compact Tapered Slot Vivaldi Antenna Array for See Through Concrete Wall UWB Applications," Proceedings of the Union of Radio Sceince, XXIX General Assembly, Aug. 7-16, 2008, Chicago, USA, 4 pages.
Weem et al. "Vivaldi Antenna Arrays for SKA," Antennas and Propagation Society International Symposium, 2000, 4 pages, (available at www.ecee.colorado.edu/microwave/docs/publications/2000/ABS_JPWbn_00.pdf).
Wu et al. "Investigation of Several Terahertz Electromagnetic Band Gap Structures," Microwave and Optical Technology Letters, vol. 52, No. 3, Dec. 2010, 9 pages.
Notice of Allowance for U.S. Appl. No. 13/401,600 mailed Jan. 17, 2014, 7 pages.
International Preliminary Report on Patentability for International (PCT) Patent Application No. PCT/US2013/026770, mailed Sep. 4, 2014, 6 pages.

* cited by examiner

DUAL-POLARIZED ARRAY ANTENNA

FIELD

A dual-polarized array antenna is provided. More particularly, a dual-polarized array antenna with multiple parallel feed elements is provided.

BACKGROUND

Tapered slot antennas, also known as Vivaldi antennas, have been developed for use in various applications. Usually, the width of the slot increases exponentially with distance from the feed point. In a typical implementation, the antenna is provided as orthogonal arrays of elements formed by conductive surfaces that define tapered slots therebetween. The conductive surfaces are usually formed on conventional printed circuit boards. More particularly, arrays of elements can be formed by using numerous printed circuit boards assembled into intersecting rows and columns in the form of a lattice type array. Accordingly, such antenna arrays are sometimes referred to as "Vivaldi egg crate arrays". These antennas typically provide a bandwidth of about 3:1 or 4:1, although some designs provide a bandwidth of about 10:1.

Although such designs can be effective, they can also be complex and difficult to manufacture. For example, in a typical Vivaldi array, multiple rows of elements can be provided by arranging multiple parallel rows of substrates having plated elements formed thereon. In order to provide a dual-polarized antenna, additional elements can be formed on multiple parallel columns of substrates having plated elements formed thereon that are arranged perpendicular to the rows of substrates. The rows and/or columns are slotted where they intersect, to form a plurality of cruciform conductive structures. However, such assemblies are prone to defects. For example, proper operation of the arrays requires a good electrical connection between orthogonal plated elements of the individual cruciform conductive structures, which is difficult to achieve. Moreover, the multiple boards are difficult to align and assemble.

The difficulty of manufacturing a typical Vivaldi array is compounded by the large number of array elements that must be combined to produce the antenna aperture. In addition, the electronics behind the aperture that drive individual array elements have been difficult to connect to the array elements. The complexity of such antenna systems is further compounded where dual-polarization operation is a required feature of the antenna. Conventional egg crate designs also make it difficult to incorporate chips, such as integrated circuits, on the circuit boards comprising the array.

SUMMARY

Embodiments of the disclosed invention are directed to solving these and other problems and disadvantages of the prior art. In particular, systems and methods for providing a dual-polarized antenna array having multiple apertures are provided. Each aperture may be formed between a pair of electrically conductive elements or posts. Moreover, some or most of the electrically conductive elements can be associated with as many as four radiating apertures, wherein two of the radiating apertures are associated with a first polarization, and two of the radiating apertures are associated with a second polarization. The first and second polarizations are generally orthogonal to one another. Feed points associated with the radiating apertures can be provided by feed elements. Each feed element can incorporate at least a portion of two feed networks, with the first feed network associated with the first polarization and the second feed network associated with the second polarization. In particular, feed points associated with the first polarization are interconnected to the first feed network, and feed points associated with the second polarization are interconnected to the second feed network. The feed points provided by a feed element may alternate such that a feed point associated with the first network and the first polarization is followed by a feed point associated with the second network and the second polarization. The electrically conductive elements may be provided as a square array of elements, in which the electrically conductive elements are integral to one another. Moreover, the feed elements may be oriented along lines that intersect multiple rows and columns of electrically conductive elements in the square array of electrically conductive elements.

Methods in accordance with embodiments of the present invention include forming a square array of electrically conductive elements from an integral piece of material. For example, rows and columns of electrically conductive elements can be formed using sawing operations, where cuts performed as part of the sawing operations can be along lines that are parallel to either the rows of electrically conductive elements or the columns of electrically conductive elements. Slots for receiving feed elements can also be formed using a sawing operation. The slots are oriented such that they intersect electrically conductive elements in different rows and columns of electrically conductive elements. After the electrically conductive elements and the slots for receiving feed elements have been formed, feed elements can be placed within the slots such that each feed point is located within a radiating aperture between an adjacent pair of electrically conductive elements. Moreover, the feed points included in any one feed element can alternate between a feed point associated with a first polarization and a feed point associated with a second polarization.

Additional features and advantages of embodiments of the disclosed invention will become more readily apparent from the following description, particularly when taken together with the accompanying drawings.

DETAILED DESCRIPTION

Figure 1:
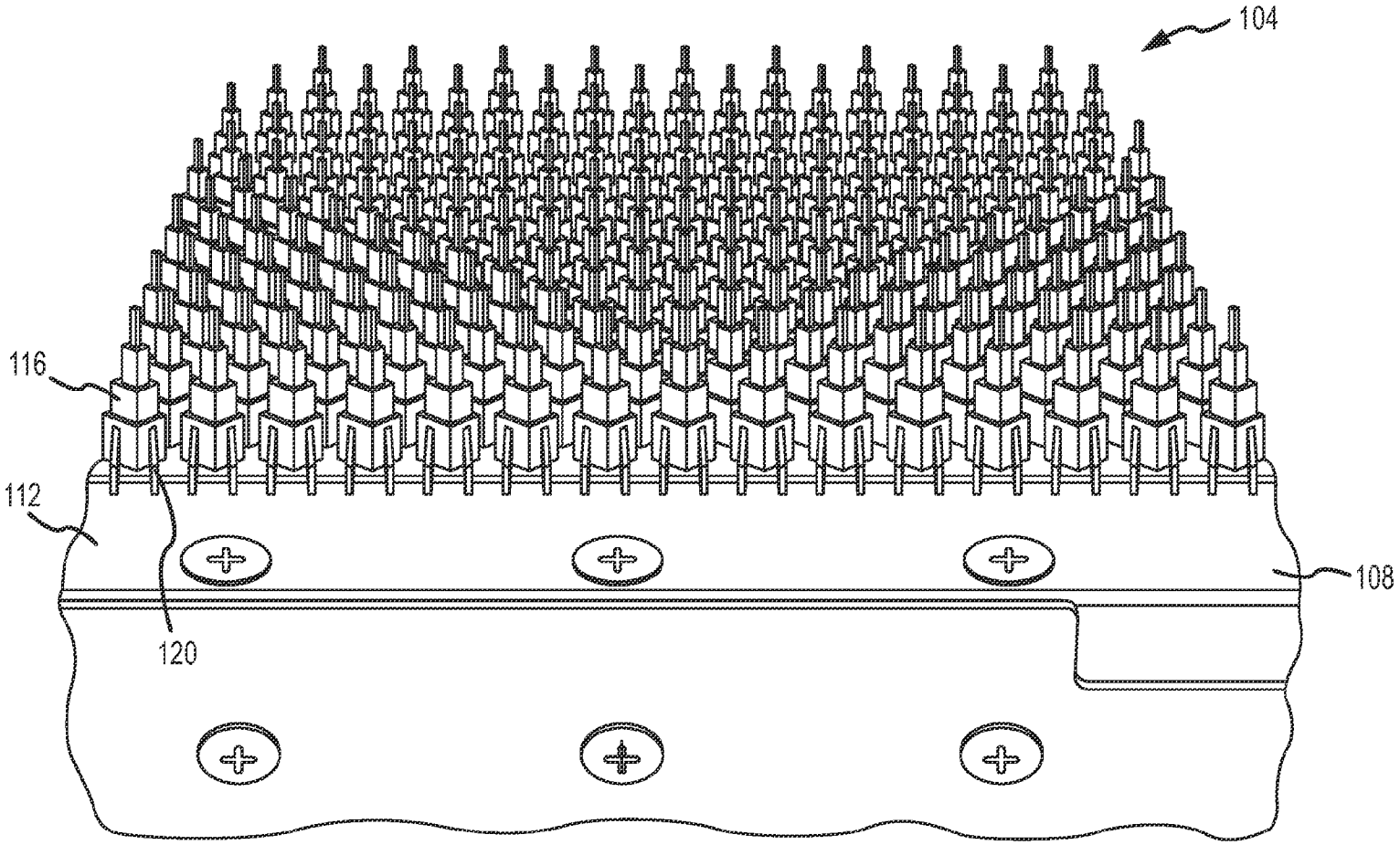
FIG. 1 is a perspective view of an array antenna in accordance with embodiments of the present disclosure.

FIG. 1 depicts an array antenna 104 in accordance with embodiments of the present disclosure. The array antenna 104 generally includes an integral antenna radiating structure 108 having a frame or border portion 112, a plurality of electrically conductive elements or posts 116, and a substrate or base 120. In general, the electrically conductive posts 116 extend from a plane defined by or coincident with the base 120. Moreover, the electrically conductive posts 116 can be stepped or tapered, such that pairs of adjacent electrically conductive posts 116 define a radiating gap therebetween. In accordance with at least some embodiments of the present disclosure, the antenna radiating structure 108 is integral in that the frame 112, electrically conductive posts 116, and base 120 are formed from a single piece of material.

Figure 2:
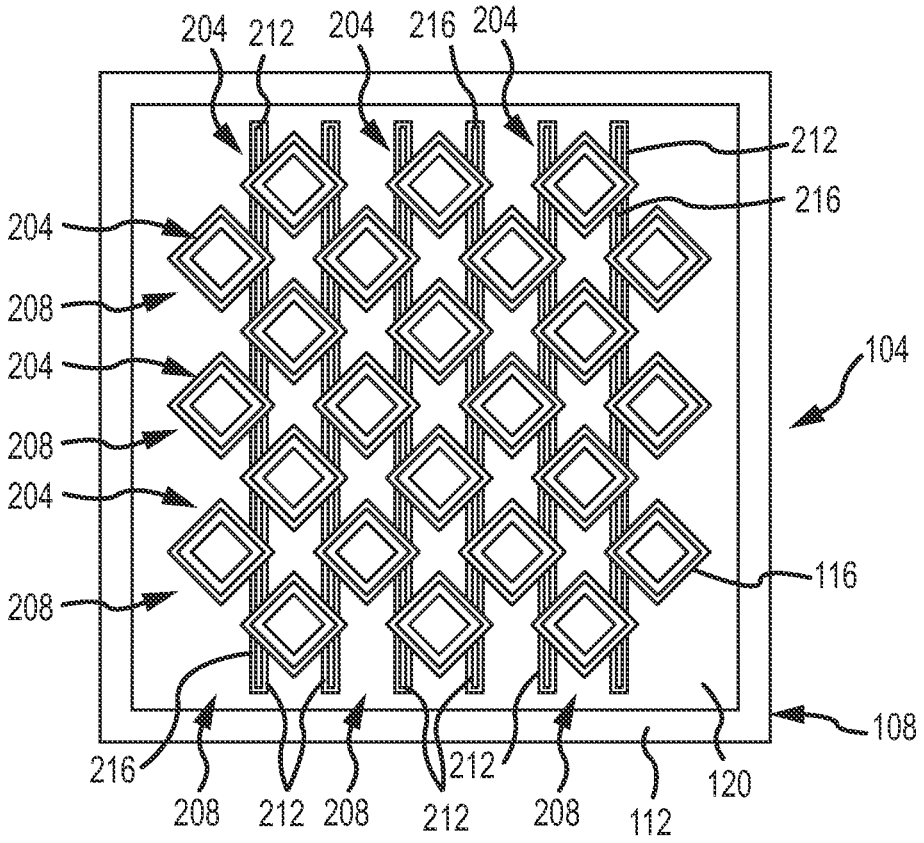
FIG. 2 is a top plan view of an array antenna in accordance with embodiments of the present disclosure.

FIG. 2 depicts an array antenna 104 in accordance with embodiments of the present disclosure in a top plan view. As shown, the electrically conductive posts 116 can be arranged to form multiple parallel rows 204, and multiple parallel columns 208. Moreover, the rows 204 and columns 208 can be arranged such that they are not parallel to the edges of the frame 112. For example, the rows 204 and columns 208 can be along a diagonal and an off-diagonal respectively (i.e., at a 45° angle) with respect to the sides of the frame 112.

A plurality of parallel slots 212 are formed in the base 120. Each of the slots 212 receives a feed element 216. Accordingly, the array antenna 104 can include a plurality of parallel feed elements 216. Moreover, each slot 212 can be the same length as any other slot 212. Similarly, each feed element 216 can be the same length as any other feed element 216. In addition, each of the slots 212 and each of the feed elements 216 intersects a plurality of electrically conductive posts 116. Moreover, the slots 212 intersect electrically conductive posts 116 in different rows 204 and/or columns 208. In accordance with embodiments of the present disclosure, the slots 212 form apertures in the base 120, but extend only partially into electrically conductive posts 116, enhancing the mechanical strength and stability of the radiating structure 108.

Figure 3:
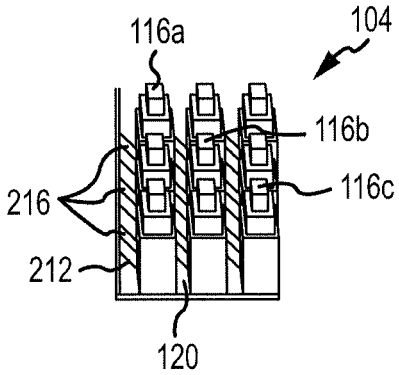
FIG. 3 is a perspective view of a portion of an array antenna in accordance with embodiments of the present disclosure.

FIG. 3 is a partial perspective view of an array antenna 104 in accordance with embodiments of the present disclosure, in which portions of feed elements 216 received by corresponding slots 212 can be seen, extending for some distance from the surface of the base 120 (i.e., from the base plane). Moreover, the distance by which the feed elements 216 extend from the base 120 is no greater than the distance that the slots 212 extend into the electrically conductive posts 116.

Figure 4:
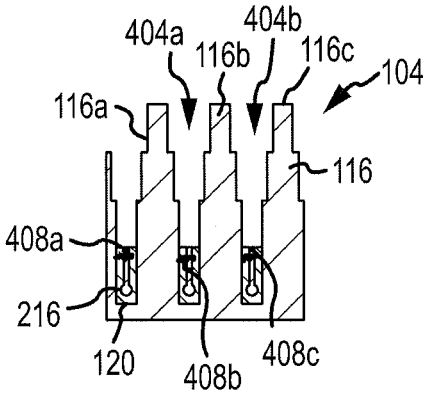
FIG. 4 is a side elevation view of a portion of an array antenna in accordance with embodiments of the present disclosure.

FIG. 4 illustrates a cross-section of a portion of an array antenna 104 in accordance with embodiments of the present disclosure taken along a line parallel to but spaced apart from a feed element 216. The electrically conductive posts 116*a*, 116*b*, and 116*c* shown in FIG. 4 correspond to the electrically conductive posts 116*a*, 116*b*, and 116*c* of FIG. 3. In this view, the radiating gaps 404 formed between adjacent pairs of electrically conductive posts 116 can be seen. In particular, a first radiating gap 404*a* is formed between the first 116*a* and second 116*b* electrically conductive posts, while a second radiating gap 404*b* is formed between the second electrically post 116*b* and the third electrically conductive post 116*c*. Associated with each radiating gap 404 is a feed point 408 provided by the feed element 216. Moreover, for a given feed element 216, each feed point 408 may alternate such that a first feed point 408*a* is associated with a first feed network and a first polarization, the next feed point 408*b* is associated with a second feed network and a second polarization, and the next feed point 408*c* is associated with the first feed network and the first polarization, as described in greater detail elsewhere herein.

Figure 5:
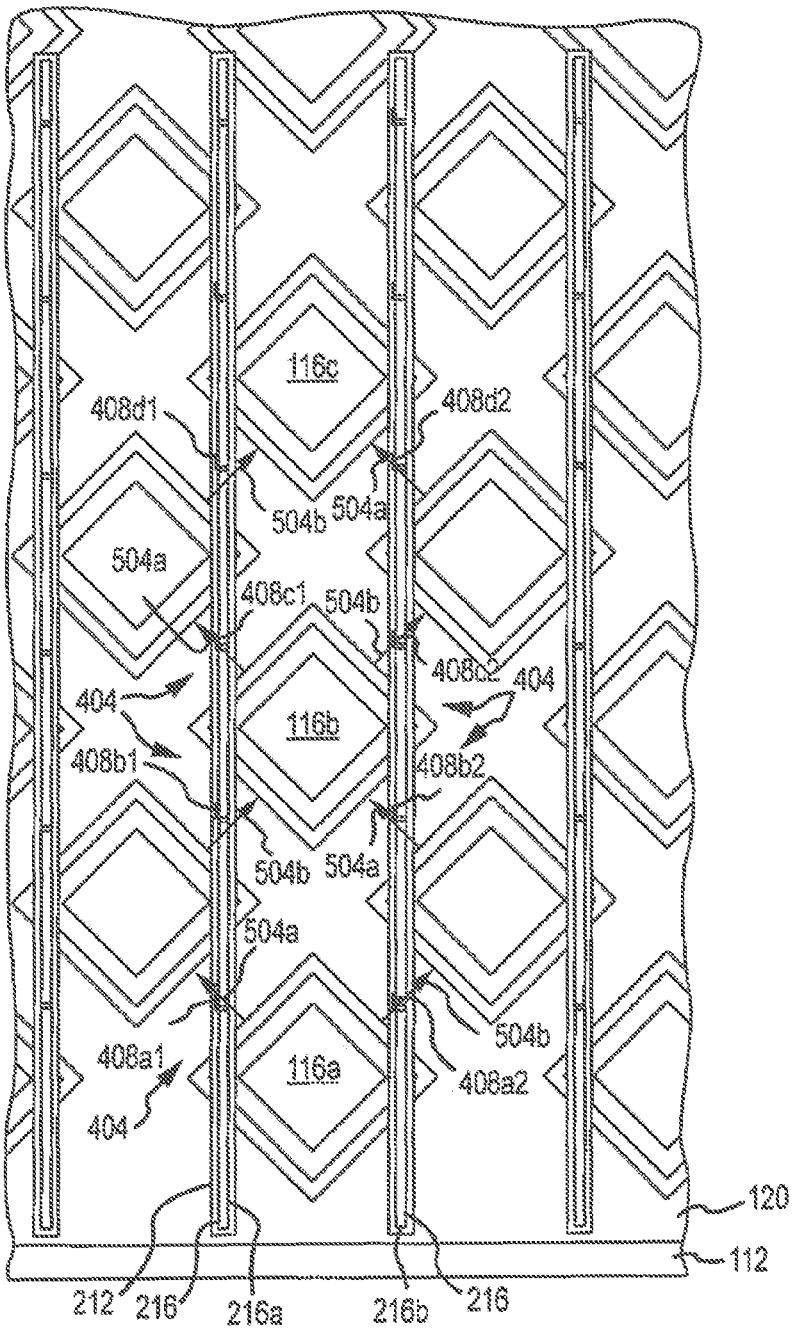
FIG. 5 is a top plan view of a portion of an array antenna in accordance with embodiments of the present disclosure.

FIG. 5 depicts a portion of an array antenna 104 in accordance with embodiments of the present disclosure in a top plan view. More particularly, a plurality of feed elements 216 and a plurality of electrically conductive posts 116 intersected by at least one of the feed elements 216 are shown. Electrically conductive posts 116*a*, 116*b*, and 116*c* correspond to electrically conductive posts 116*a*, 116*b*, and 116*c* in FIGS. 3 and 4. As previously noted, the feed points 408 provided by the feed element 216 are located within or adjacent the radiating gaps 404 between pairs of adjacent electrically conductive posts 116. In general, most of the electrically conductive posts 116 included in the array antenna 104 cooperate with at least two, and as many as four, other electrically conductive posts 116, to define radiating gaps 404 therebetween. For example, electrically conductive posts 116*a* and 116*b*, which are in an interior of the array antenna 104 each partially define four radiating gaps 404. Electrically conductive post 116*c*, which is a border or edge post 116 partially defines two radiating gaps 404. Moreover, these radiating gaps 404 for any one electrically conductive post 116 are aligned with one of two orthogonal orientations. By separately feeding these orthogonal radiating gaps 404, dual polarized operation of the array antenna 104 is possible. More particularly, in accordance with embodiments of the present disclosure, dual polarized operation of the array antenna 104 can be achieved by incorporating feed elements 216 with feed points 408 associated with feed lines carrying signals having alternate polarizations. Accordingly, for a first feed element 216*a* a first feed point 408*a*1 can be associated with a first polarization 504*a*, a second feed point 408*b*1 can be associated with a second polarization 504*b*, a third feed point 408*c*1 can be associated with the first polarization 504*a*, a fourth feed point 408*d*1 can be associated with the second polarization 504*b*, and so on. For a second feed element 216*b*, a first feed point 408*a*2 can be associated with the second polarization 504*b*, a second feed point 408*b*2 can be associated with the first polarization 504*a*, a third feed point 408*c*2 can be associated with the second polarization 504*b*, a fourth feed point 408*d*2 can be associated with the first polarization 504*a*, and so on. As shown, the electrically conductive posts 116 can be square in cross-section when viewed along a longitudinal axis of the electrically conductive posts 116. Alternatively, the electrically conductive posts 116 can be, for example, circular, in the form of a clover leaf, or in the form of a plus sign.

Figure 6:
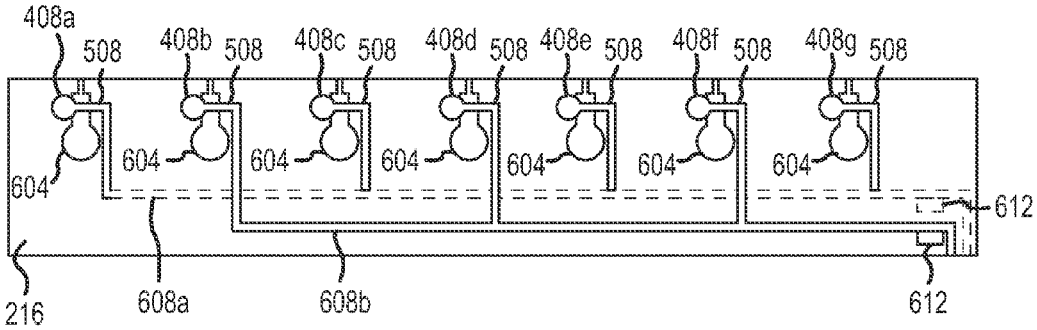
FIG. 6 depicts a feed element in accordance with embodiments of the present disclosure.

FIG. 6 depicts a feed element 216 comprising a planar board or substrate 602 in accordance with embodiments of the present invention in elevation. The feed element 216 includes a linear array of feed points 408. Each feed point 408 is associated with a slot line 604 formed in the substrate 602. For example, as can be appreciated by one of skill in the art after consideration of the present disclosure, each feed point 408 may comprise or be associated with a strip line 508 that crosses a slot line 604 and that terminates in the feed point 408. The feed element 216 can additionally include strip lines or other elements included as part of first 608*a* and second 608*b* feed networks. The included feed points 408 are alternately interconnected to either the first feed network 608*a* or the second feed network 608*b*. Accordingly, as shown in the illustrated example, the first 408*a*, third 408*c*, fifth 408*e*, and seventh 408*g* feed points are interconnected to the first feed network 608*a*. The second 408*b*, fourth 408*d*, and sixth 408*f* feed points are interconnected to the second feed network 608*b*. Portions of the first feed network 608*a* are illustrated using dotted lines, to indicate that those portions are on a side of the feed element 216 opposite the side in view in this example. Accordingly, the strip line portions 508 can be interconnected to the dotted line portions of the first feed network 512*a* through conductive vias formed in the substrate of the feed element 216. As can be appreciated by one of skill in the art after consideration of the present invention, the feed networks 608*a* and 608*b* are associated with first and second polarizations respectively. Also, the feed networks 608*a* and 608*b* can incorporate various elements or devices 612.

Examples of such elements 612 include, but are not limited to, amplifiers, phase shifters, multiplexers, combiners, attenuators, and filters. Moreover, such devices 612 can include surface mount devices interconnected to the surface of the feed element 216 substrate 602. Where such elements or devices 612 comprise active devices, the feed element 216 can additionally incorporate control lines associated with such devices 612. In accordance with embodiments of the present disclosure, the feed element 216 substrate 602 can comprise a circuit board formed using conventional techniques.

Figure 7:
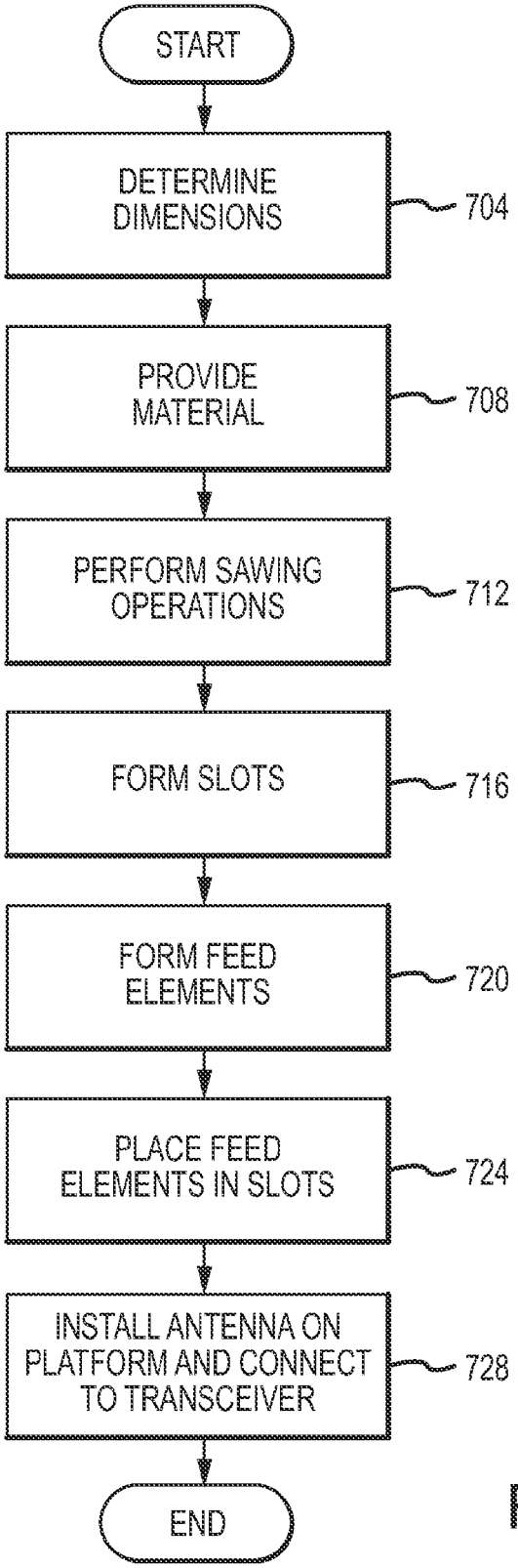
FIG. 7 depicts aspects of a method for providing a dual-polarized array antenna in accordance with embodiments of the present disclosure.

With reference now to FIG. 7, aspects of a method for providing a dual polarized array antenna 104 in accordance with embodiments of the present invention are illustrated. Initially, at step 704, the dimensions of the array antenna 104 and the included electrically conductive posts 116 and associated gaps 404 are determined. As can be appreciated by one of skill in view of the present disclosure, the antenna array 104 dimensions are in large part determined by various operational and environmental considerations, including but not limited to the desired operating frequency range bandwidth, beam steering angles, gain, area available on a vehicle or other platform for receiving or housing the array antenna 104, characteristics of the ambient operating environment, etc.

At step 708, a block of material is provided, and a sawing operation is initiated to form the rows 204 of electrically conductive posts 116. In general, the block of material comprises an electrically conductive material, such as but not limited to aluminum. The rows 204 of electrically conductive posts 116 can be formed sequentially using a series of saw cuts. Alternatively, features of the rows 204 of electrically conductive posts 116 can be formed in parallel, using multiple saws simultaneously.

At step 712, sawing operations are performed to form columns 208 of electrically conductive posts 116 according to the selected electrically conductive posts 116 and gap 404 dimensions. The formation of columns 208 of electrically conductive posts 116 can be performed sequentially or in parallel.

At step 716, slots 212 are formed on a side of the base 120 opposite the side on which the cuts for the rows and columns of electrically conductive posts 116 were formed. The formation of slots 212 can be performed by additional sawing operations. The slots 212 are aligned such that each slot 212 intersects multiple rows 204 and columns 208 of electrically conductive posts 116. For example, where the rows 204 and columns 208 of electrically conductive posts 116 form a square array or lattice, the slots 212 can be at 450 to the rows 204 and columns 208 of electrically conductive posts 116. In addition, the depth of the slots 212 can be controlled such that the slots 212 partially extend into the electrically conductive posts 116 intersected by the slots 212. This configuration improves the mechanical strength of the array antenna 104.

At step 720, feed elements 216 are formed. The number of feed elements 216 required for an array antenna 104 is equal to the number of slots 212. In general, each feed element 216 is formed with multiple feed points 408. Moreover, the feed points 408 are alternately connected to either a first feed network 604*a* or a second feed network 604*b*. In accordance with embodiments of the present invention, the feed elements 216 can be identical to one another. The formed feed elements 216 can then be placed in the slots 212 (step 724). By placing a feed element 216 in each of the slots 212, a feed point 408 is located within or near the radiating gaps 404 between adjacent electrically conductive posts 116. The array antenna 104 can then be installed on a vehicle or other platform, and the first and second feed networks 608 can be connected to transceiver electronics (step 728). The process can then end.

As can be appreciated by one of skill in the art after consideration of the present disclosure, embodiments of the present invention provide an array antenna 104 with multiple radiating gaps 404. Moreover, radiating gaps 404 between electrically conductive posts 116 within the same row 204 are each associated with feed points 408*a* connected to a first network 608*a* that provides a signal having a first polarization. Radiating gaps 404 between electrically conductive posts 116 within the same column 208 are associated with feed points 408*b* connected to a second network 608*b* that provides a signal having a second polarization. Accordingly, a dual polarized array antenna 104 is provided. In addition, the array antenna 104 can be formed using simple machining techniques. For example, sawing operations can be used to form stepped electrically conductive posts 116 in rows 204 and columns 208 to define a plurality of orthogonal radiating gaps 404. Sawing operations can also be used to form slots 212 to receive feed elements 216 to transmit and/or receive electromagnetic energy in association with the radiating gaps 404. Accordingly the complexity of the antenna array 104 assembly and the cost of producing the antenna array 104 can be reduced, for example as compared to conventional Vivaldi egg crate type arrays. In addition, because the antenna array 104 can provide electrically conductive posts 116 formed from a single piece of material, the structural integrity of the antenna array 104 is high.

In accordance with still other embodiments, other configurations of electrically conductive posts 116 can be provided. For example, electrically conductive posts 116 can comprise curved or smoothly tapered surfaces to define radiating gaps 404. Alternatively or in addition, an electrically conductive post 116 can be square, circular, in the form of a cloverleaf, in the form of a plus sign, or some other shape when viewed along a longitudinal axis of the electrically conductive posts 116.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. An antenna, comprising:

a plurality of electrically conductive posts, wherein the electrically conductive posts are arranged in rows and columns;

a plurality of feed elements, wherein the feed elements are arranged along parallel lines, wherein at least some of the feed elements intersect a plurality of rows and a plurality of columns of the plurality of electrically conductive posts, wherein a first feed element in the plurality of feed elements includes a plurality of feed points, wherein each feed point in the plurality of feed points of the first feed element at least one of occupies or is adjacent a gap between two adjacent electrically conductive posts, wherein feed points included in a first subset of the plurality of feed points of the first feed elements are interconnected to a first feed network, wherein feed points included in a second subset of the plurality of feed points of the first feed element are interconnected to a second feed network, and wherein the feed points included in the first subset of the plurality of feed points of the first feed element alternate with feed points included in the second subset of the plurality of feed points of the first feed element.

2. The antenna of claim 1, wherein the first feed network is operable with respect to signals having a first polarization, and wherein the second feed network is operable with respect to signals having a second polarization.

3. The antenna of claim 1, further comprising:

a base, wherein at least a portion of the base occupies a base plane, and wherein the plurality of electrically conductive posts extend from a first side of the base plane.

4. The antenna of claim 3, wherein each electrically conductive post in the plurality of electrically conductive posts extends along an axis that is orthogonal to the base plane.

5. The antenna of claim 3, wherein the plurality of electrically conductive posts are integral to the base.

6. The antenna of claim 5, wherein a plurality of parallel slots are formed in the base, and wherein each slot in the plurality of parallel slots receives at least a portion of a respective feed element included in the plurality of feed elements.

7. The antenna of claim 1, wherein each feed element in the plurality of feed elements is a first length.

8. The antenna of claim 7, wherein each feed element in the plurality of feed elements includes a planar circuit board.

9. The antenna of claim 1, wherein the plurality of electrically conductive posts are arranged in a square array.

10. The antenna of claim 9, wherein the feed elements are arranged along parallel lines that are each at a 45 degree angle to the rows and columns of the plurality of electrically conductive posts.

11. The antenna of claim 3, wherein at least a base portion of each electrically conductive post in the plurality of electrically conductive posts is square within a plane that in parallel to the base plane.

12. A method for providing an antenna, comprising:

forming a plurality of electrically conductive posts on a first substrate, wherein the plurality of posts are arrayed along a plurality of rows and a plurality of columns, and wherein a plurality of parallel slots are formed in the first substrate, wherein each of the slots intersects a plurality of the rows and a plurality of the columns of the posts;

providing a plurality of feed elements;

placing one feed element included in the plurality of feed elements in each slot formed in the first substrate, wherein each feed element includes a plurality of feed points included in a first set of feed points, and a plurality of feed points included in a second set of feed points, wherein placing one feed element in the plurality of feed elements in each slot formed in the first substrate includes placing feed points within radiating gaps between adjacent posts;

interconnecting the first set of feed points to a first signal interface of a transceiver;

interconnecting the second set of feed points to a second signal interface of the transceiver, wherein for any one of the feed elements feed points included in the first set of feed points alternate with feed points included in the second set of feed points.

13. The method of claim 12, further comprising:

at least one of transmitting or receiving a first signal having a first polarization through the first signal interface;

at least one of transmitting at least one of the first signal or a second signal having a second polarization through the second signal interface.

14. The method of claim 12, wherein the plurality of posts are integral to the first substrate, and wherein the plurality of posts are formed using sawing operations only.

15. An antenna system, comprising:

a substrate;

an array of posts extending from a first side of the substrate, wherein the posts are arranged in a plurality of rows and a plurality of columns;

a plurality of slots formed in the substrate, wherein each slot intersects a plurality of posts, and wherein each post intersected by any one slot is included in a different row and column than any other post intersected by the slot;

a plurality of feed elements, wherein each feed element occupies at least most of a slot included in the plurality of slots, and wherein each feed element includes portions of first and second feed networks, wherein each of the first and second feed networks includes a plurality of feed points, wherein the feed points for each feed element alternate along the length of the feed element between a feed point included in the first feed network and a feed point included in the second feed network, and wherein each gap between adjacent posts is partially occupied by a feed point.

16. The antenna system of claim 15, wherein the plurality of feed elements each includes:

a planar substrate;

a plurality of electrically conductive traces defining the first and second feed networks and the feed points, wherein each slot in the plurality of slots is parallel to any other slot in the plurality of slots, and wherein each planar substrate of each feed element is parallel to the planar substrate of any other feed element.

17. The antenna system of claim 15, wherein the feed elements include circuit boards.

18. The antenna system of claim 15, wherein all of the feed elements are a first length.

19. The antenna system of claim 15, wherein the posts are integral to the substrate.

20. The antenna system of claim 15, wherein the posts are square in cross-section.

* * * * *